US010369805B2

(12) United States Patent
Kim

(10) Patent No.: US 10,369,805 B2
(45) Date of Patent: Aug. 6, 2019

(54) METHOD FOR CARRYING OUT PRINTING ON INNER AND OUTER SURFACES OF BUILDING

(71) Applicant: HUMAN KOREA. CO., LTD., Gwangju-si, Gyeonggi-do (KR)

(72) Inventor: Ki Ho Kim, Gwangju-si (KR)

(73) Assignee: HUMAN KOREA. CO., LTD., Gwangju-si Gyeonggi-do (KR)

( * ) Notice: Subject to any disclaimer, the term of this patent is extended or adjusted under 35 U.S.C. 154(b) by 0 days.

(21) Appl. No.: 15/578,468

(22) PCT Filed: Jun. 9, 2016

(86) PCT No.: PCT/KR2016/006136
§ 371 (c)(1),
(2) Date: Nov. 30, 2017

(87) PCT Pub. No.: WO2016/204450
PCT Pub. Date: Dec. 22, 2016

(65) Prior Publication Data

US 2018/0170082 A1 Jun. 21, 2018

(30) Foreign Application Priority Data

Jun. 18, 2015 (KR) ..... 10-2015-0086662

(51) Int. Cl.
*B41J 3/407* (2006.01)
*B41M 5/00* (2006.01)
(Continued)

(52) U.S. Cl.
CPC ..... *B41J 3/407* (2013.01); *B41J 3/28* (2013.01); *B41J 11/0015* (2013.01);
(Continued)

(58) Field of Classification Search
CPC ..... B41J 3/407; B41J 11/0015; B41J 3/28; B41M 5/0011; B41M 5/0047;
(Continued)

(56) References Cited

U.S. PATENT DOCUMENTS 9,327,518 B1 * 5/2016 Hexum ..... B41J 11/0015
2007/0115336 A1 * 5/2007 Ko ..... B41J 3/407 347/102
(Continued)

FOREIGN PATENT DOCUMENTS

JP 08-126861 A 5/1996
JP 09-201564 A 8/1997
(Continued)

*Primary Examiner* — Geoffrey S Mruk
(74) *Attorney, Agent, or Firm* — Novick, Kim & Lee, PLLC; Jae Youn Kim

(57) ABSTRACT

Provided is a method for carrying out printing on the inner and outer surfaces of a building. The method includes printing print text on the inner and outer surfaces of the building by using a printing apparatus in which a printing ink to be used for a piezo method or a printing ink made of a UV curable material can be placed in a spray means according to a user's selection, the piezo method or a UV curing method can be selected according to the type of printing ink placed in the spray means, and spraying of the printing ink of the piezo method or the UV curing method, curing and spraying of a coating agent are sequentially carried out during driving since the spray means, a curing means and a coating agent application means are sequentially arranged.

16 Claims, 4 Drawing Sheets

(51) Int. Cl.

| | |
|---|---|
| ***B05D 3/06*** | (2006.01) |
| ***B41M 7/00*** | (2006.01) |
| ***G09F 19/22*** | (2006.01) |
| ***B41J 3/28*** | (2006.01) |
| ***B41J 11/00*** | (2006.01) |
| *B41M 3/06* | (2006.01) |
| *B05D 3/12* | (2006.01) |
| *B05D 3/00* | (2006.01) |

(52) U.S. Cl.
CPC ..... *B41M 5/0011* (2013.01); *B41M 5/0047* (2013.01); *B41M 7/00* (2013.01); *B41M 7/0081* (2013.01); *G09F 19/22* (2013.01); *B05D 3/002* (2013.01); *B05D 3/065* (2013.01); *B05D 3/12* (2013.01); *B41M 3/06* (2013.01); *B41M 5/007* (2013.01); *B41M 2205/12* (2013.01)

(58) Field of Classification Search
CPC ..... B41M 7/0081; B41M 7/00; B41M 5/007; B41M 2205/12; B41M 3/06; G09F 19/22; B05D 3/002; B05D 3/065; B05D 3/12
See application file for complete search history.

(56) References Cited

U.S. PATENT DOCUMENTS

| | | | | |
|---|---|---|---|---|
| 2012/0164402 | A1* | 6/2012 | Murakami | C04B 41/009 428/195.1 |
| 2015/0258846 | A1* | 9/2015 | Daniels | B41M 5/0011 428/142 |

FOREIGN PATENT DOCUMENTS

| | | | |
|---|---|---|---|
| KR | 10-0654661 | B1 | 12/2006 |
| KR | 10-2007-0028352 | A | 3/2007 |
| KR | 10-2008-0064402 | A | 7/2008 |
| KR | 10-0920672 | B1 | 10/2009 |
| KR | 10-2012-0040613 | A | 4/2012 |
| WO | 2008-140694 | A1 | 11/2008 |

* cited by examiner

METHOD FOR CARRYING OUT PRINTING ON INNER AND OUTER SURFACES OF BUILDING

TECHNICAL FIELD

The present invention relates to a method for carrying out printing on inner and outer surfaces of a building, which carries out printing of various types of advertisement texts and designs and texts such as warning texts and announcement texts, and the like on the inner and outer surfaces (inner and outer surfaces, walls, roofs, rooftops, etc.), and more particularly, to a method for carrying out printing on inner and outer surfaces of a building, which is capable of printing clearer texts on the surfaces of the building built with a concrete structure and also performing high-quality printing that is capable of preventing print texts from being damaged even when used for a long time.

BACKGROUND ART

Generally, in concrete buildings such as apartments, schools, religious buildings, public buildings, hotels, dormitories, hospitals, and shopping malls, print texts having various texts are displayed on the inner and/or outer walls of the buildings to improve the dignity of the buildings.

As such, characters, pictures, and images that express sophistication or various pieces of information in buildings are useful for advertisement and promotional purposes.

Such a method for carrying out printing on the inner and outer surface is disclosed in Korean Patent Publication No. 10-2008-64402 (Title: AN ADVERTISEMENT DISPLAY LAYER PROVIDED WITH PARKING PLACE BOTTOM). In the printing method, as disclosed in the Patent Gazette, provided are a finishing layer for applying a top surface of a concrete slab constituting inner and outer surfaces of an apartment and a building or a large parking lot; and an advertisement display layer provided on the finish layer so as to display an advertisement message through a painting (printing) process.

Through the method for carrying out the printing as described above, it is possible to deliver a natural and continuous advertisement message through the floor of the parking lot where the users come and go through the vehicle, such as apartments and buildings or large discount marts.

In addition, in a method for carrying out printing, which is disclosed in Korean Patent Publication No. 10-2007-28352 (Title: SYSTEM AND METHOD OF PAVEMENT ADVERTISING), as disclosed in the Patent Gazette, provided are a wheel-mounted moving device including a marking solution supply source; a dispensing means for spraying the marking solution onto a surface; and a control means for controlling a release rate of the marking solution. The control means includes a computer-actuated plotter for controlling a path of at least one dispensing nozzle associated with the dispensing means to form an image on the road surface.

Thus, since the print text is printed in consideration of a degree of wear of the print text due to a degree of road aging, the print text may be maintained on the road surface for a long time.

In addition, in a method for carrying out printing, which is disclosed in Korean Patent Registration No. 10-654661 (Title: PAVEMENT STRUCTURE OF A ROAD WITH PRINTING PATTERNS), as disclosed in the Patent Gazette, in forming a road pavement by embedding a specific image therein, a reinforcing material is paved on the top of a base layer of a prepared road surface, and a primer is applied and cured, and then, an image attaching layer is formed on a surface of the cured primer, and a transparent resin is applied to the top of the image attaching layer to form a transparent surface layer, thereby improving aesthetics of streets and reminding characteristics of cities and streets and milestones to pedestrians.

DISCLOSURE OF THE INVENTION

Technical Problem

However, the conventional method for carrying out the printing on various inner and outer surfaces as described above may be adequately carried out on the outdoor spaces such as roads and sidewalks, but be difficult to be applied to the indoor spaces such as the inner and outer surfaces of the buildings.

That is, in the indoor spaces of the buildings, the construction method using the simple painting may be mainly used.

The present invention has been proposed in order to solve the above problems, and an object of the present invention is to provide a method for carrying out printing on inner and outer surface of a building, in which ink made of a UV curable material is applied in a UV curing method to perform the printing on the inner and outer surfaces of the building, thereby printing clearer texts on the surfaces of the building built with a concrete structure and also performing high-quality printing that is capable of preventing print texts from being damaged even when used for a long time.

Also, the present invention provides a method for carrying out printing on buildings and all concrete floors and walls, in which ink is sprayed onto the buildings and all the concrete floors and walls by applying electrical vibration and a physical pressure to allow the ink to be permeated into the concrete and perform the printing on the concrete surfaces, thereby printing clearer texts on the surfaces of the building built with a concrete structure and also performing high-quality printing that is capable of preventing print texts from being damaged even when used for a long time.

Also, an object of the present invention is to provide a method for carrying out printing, which is capable of applying a coating agent while forming a print text on a surface of a building by using a printing apparatus.

Technical Solution

To achieve the abovementioned object of the present invention, a method for carrying out printing on inner and outer surfaces of a building, which performs printing of a print text on the inner and outer surfaces of the building by using a printing apparatus (1) in which printing ink used for a piezo method or printing ink made of a UV curable material is contained in a spray means (2) according to user's selection, the piezo method or a UV curing method is selected according to a type of printing ink contained in the spray means (2), and the spray means (2), a curing means (11), and a coating agent application means (14) are sequentially disposed to sequentially perform spraying of the printing ink in the piezo method or the UV curing method, curing of the printing ink, and spraying of a coating agent while the apparatus travels, the method including: a preprocessing step of removing foreign matters from the inner and outer surfaces of the building; a printing step of applying ink made of the UV curable material onto the inner and outer surfaces of the building, which is cleaned through the pre-processing step, by using the spray means (2) of the printing apparatus (1) and curing the applied ink through ultraviolet rays (UV) by using the curing means (11) of the printing apparatus (1) to adhere, thereby forming the print text; a coating step of applying the coating agent by using the coating agent application means (14) to prevent the surfaces of the building from being neutralized and reinforce the surfaces in the state in which the print text is formed on the surfaces of the building through the printing step; a glossing step of polishing the inner and outer surfaces by using a diamond resin pad when the coating of the surfaces by using the coating agent is completed through the coating step; and a surface protection agent coating step of applying a water repellent agent onto the surfaces of the building, which are polished through the glossing step, to buff the surfaces by using a buffing pad, thereby performing water repellent on the surfaces of the building, wherein the printing apparatus (1) operates to be selected to the UV curing method of the piezo method or the UV curing method through an input of a separate switch or keypad means (8) to operate, and the coating agent application means (14) is mounted on a rear end of a body (3) or the curing means (11) to spray the coating agent to the UV-cured position, in the printing step and the coating step, a desired amount of printing ink and an amount of coating agent to be applied are measured by using a distance measuring function of the printing apparatus (1) to form the print text by using the measured amounts, and the body (1) has a plate shape and is provided with the spray means (2) therein or on a surface thereof, and a moving means (4) receiving power to move the body (3) in front/rear and left/right sides is disposed on each of both ends of the body (3).

To achieve the abovementioned object of the present invention, a method for carrying out printing on inner and outer surfaces of a building, which performs printing of a print text on the inner and outer surfaces of the building by using a printing apparatus (1) in which printing ink used for a piezo method or printing ink made of a UV curable material is contained in a spray means (2) according to user's selection, the piezo method or a UV curing method is selected according to a type of printing ink contained in the spray means (2), and the spray means (2), a curing means (11), and a coating agent application means (14) are sequentially disposed to sequentially perform spraying of the printing ink in the piezo method or the UV curing method, curing of the printing ink, and spraying of a coating agent while the apparatus travels, the method including: a pre-processing step of removing foreign matters from a surface of concrete constituting the surfaces of the building; a spray step of spraying a water-soluble metallic salt stain to the inner and outer surfaces of the building, which are cleaned through the pre-processing step, by using the spray means (2) of the printing apparatus (1) in the piezo method by applying electrical vibration and a physical pressure in a direction of the surface to allow the metallic salt stain to be permeated into the surfaces of the building and thereby to form the print text; a coating step of applying and drying the coating agent by using the coating agent application means (14) of the printing apparatus (1) to prevent the surfaces of the building from being neutralized and reinforce the surfaces in the state in which the print text is formed on the surfaces of the building through the spray step; a glossing step of polishing the surfaces by using a diamond resin pad when the coating on the surfaces by using the coating agent is completed through the coating step; and a surface protection agent coating step of applying a water repellent agent onto the surfaces, which are polished through the glossing step, to buff the surfaces by using a buffing pad, thereby performing water repellent on the surfaces of the building, wherein the printing apparatus (1) operates to be selected to the piezo method of the piezo method or the UV curing method through an input of a separate switch or keypad means (8) to operate, and the coating agent application means (14) is mounted on a rear end of a body (3) or the curing means (11) to spray the coating agent to the position at which the printing ink is sprayed in the piezo method, in the printing step and the coating step, a desired amount of printing ink and an amount of coating agent to be applied are measured by using a distance measuring function of the printing apparatus (1) to form the print text by using the measured amounts, and the body (1) has a plate shape and is provided with the spray means (2) therein or on a surface thereof, and a moving means (4) receiving power to move the body (3) in front/rear and left/right sides is disposed on each of both ends of the body (3).

Advantageous Effects

In the method for carrying out the printing on the inner and outer surfaces of the building according to the present invention, the print text may be formed on the building and the concrete floors and walls in the indoor and outdoor parking lots of the building, the playgrounds, and the like, and also, since the print text adheres to and is integrated with the surface of the building in the state in which the print text is cured through the ultraviolet rays (UV), the print text may be clear and particularly be stable because the print text is not damaged even when a long time passes.

Also, in the printing of the UV curable material, the UV curable material may be cured in the UV curing method, unlike the general painting, to improve the durability, and also may be printed to any surfaces such as the concrete, the tile, the floor, the carpet, and the like and embossed (protruding up to a height of 0.1 mm to 1 mm) after printing to provide the stereoscopic effect.

In case of the printing by the piezo method, since the print text is permeated into building and concrete floors and walls and thus formed permanently, the print text may be stable because the print text is not damaged even when a long time passes.

Also, the printing apparatus performing the method for carrying out the printing on the inner and outer surfaces of the building may datafy the states of the inner and outer surfaces of the building that is the printing object, which are inputted through the photographing means and the distance measuring means to grasp the states and also datafy the printing conditions through the keypad means and the display means to input the data so that the printed contents such as the text and design according to the inputted data are printed on the surface of the printing object while traveling by the moving means, and particularly, the surface of the building, which is built with the concrete structure, may be economical and reduced in construction, and the printing effect of the building may be improved.

In case of the printing construction on the inner and outer surfaces of the building by using the printing apparatus, the printing process of forming the print text and the process of applying the coating agent in the state in which the print text is formed may be performed at the same time by using one apparatus to reduce the costs and the working time.

Also, when the 3D printing is performed in the piezo or UV curing method by using the printing apparatus according to the present invention, since it is actually get a real enough thing to be mistaken, when Niagara Falls are 3D-printed, it is so effective that people do not actually approach the image. Also, in case in which the marble pattern is printed, it may have an effect of showing quality that is hard to distinguish from the actual marble.

MODE FOR CARRYING OUT THE INVENTION

Figure 1:
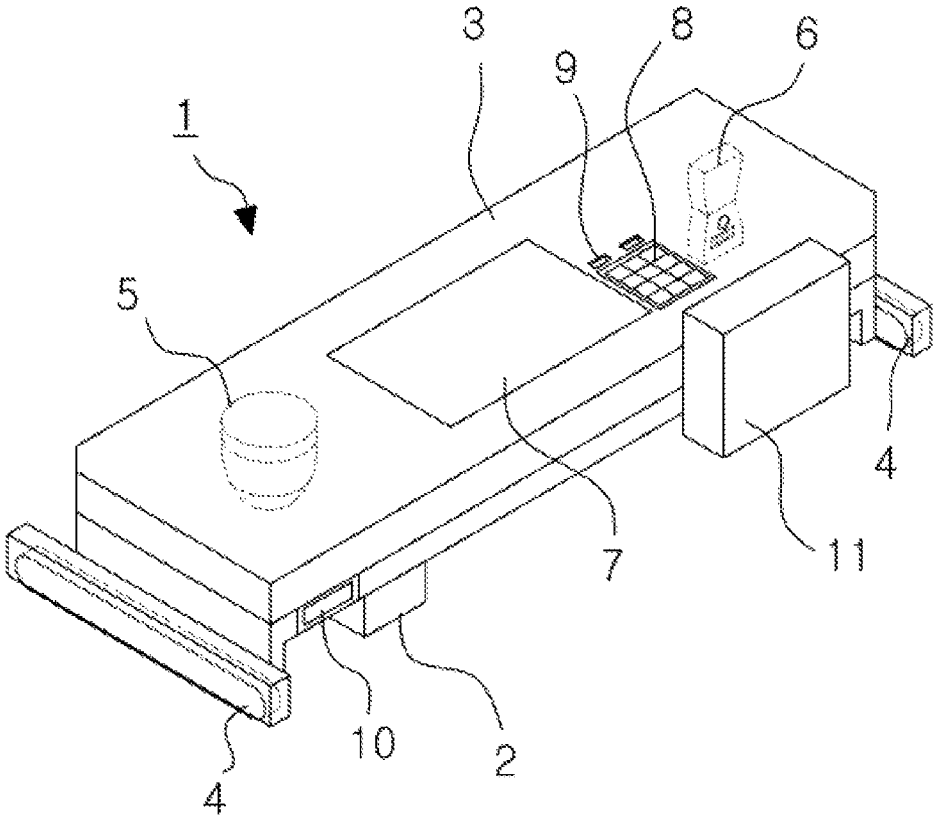
FIG. 1 is a perspective view of an apparatus for carrying out printing on inner and outer surfaces of a building according to an embodiment of the present invention.

Hereinafter, a method for carrying out printing on inner and outer surfaces of a building according to a preferred embodiment of the present invention will be described in detail.

The embodiments of the present invention may, however, be embodied in different forms and should not be constructed as limited to the embodiments set forth herein. Rather, these embodiments are provided so that this disclosure will be thorough and complete, and will fully convey the scope of the present invention to those skilled in the art. In the drawings, the shapes of a component, etc., are expressed to be exaggerated for clarity. It should be noted that in the drawings, the same member is denoted by the same reference numeral. Moreover, detailed descriptions related to well-known functions or configurations will be ruled out in order not to unnecessarily obscure subject matters of the present invention.

First, a printing apparatus used in a method for carrying out printing on inner and outer surfaces of a building according to the present invention will be described.

Figure 2:
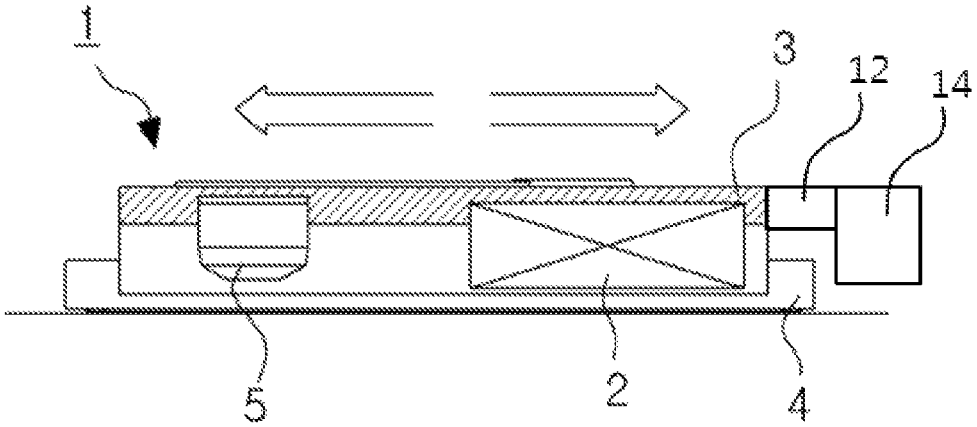
FIGS. 2 and 3 are views illustrating a use state of the apparatus for carrying out the printing on the inner and outer surfaces of the building according to an embodiment of the present invention.
Figure 3:
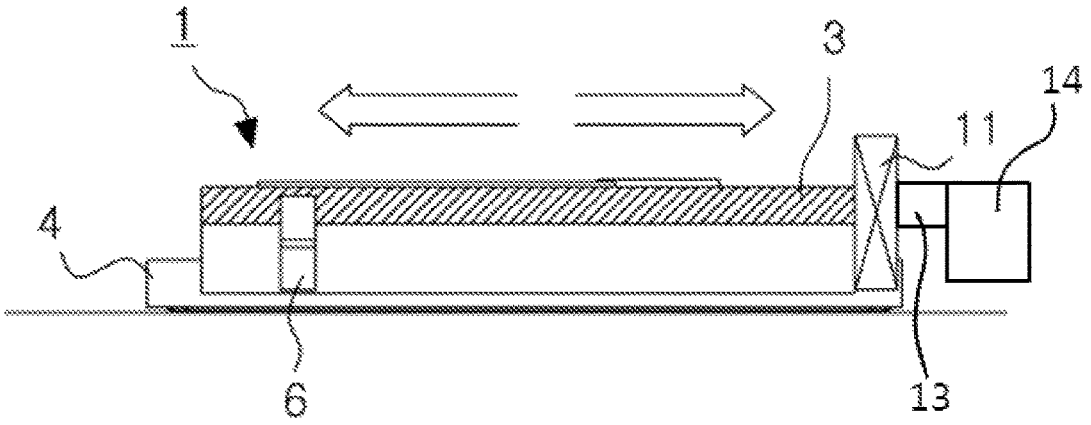
Figure 4:
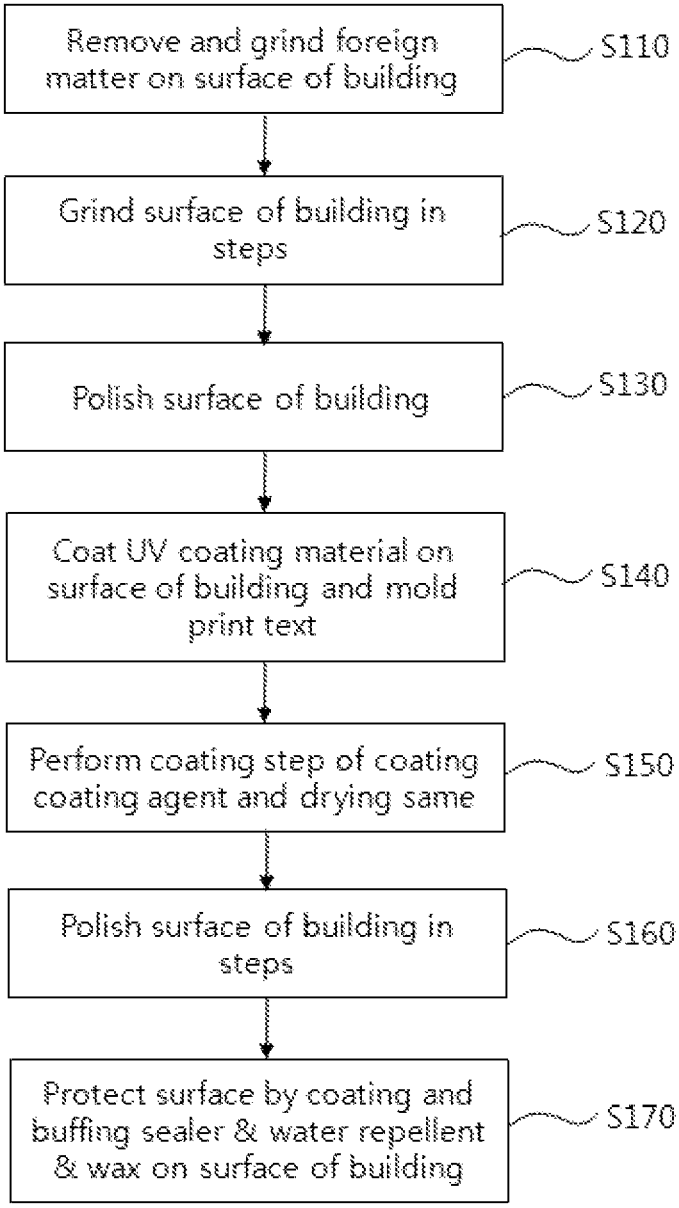
FIG. 4 is a schematic view illustrating a method for carrying out printing on inner and outer surfaces of a building according to a first embodiment of the present invention.
Figure 5:
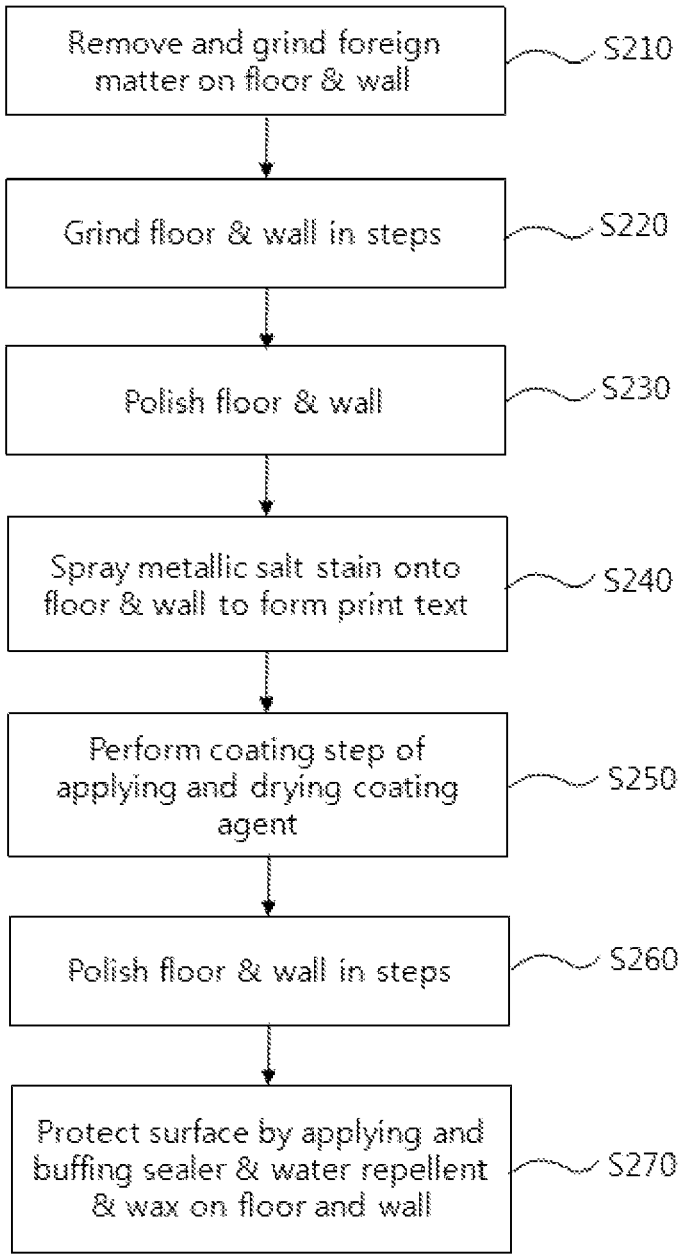
FIG. 5 is a schematic view illustrating a method for carrying out printing on inner and outer surfaces of a building according to a second embodiment of the present invention.

Referring to FIGS. 1 to 3, a printing apparatus 1 includes a spray means 2 for spraying a printing material onto inner and outer surfaces of a building and a coating agent application means 14 for applying a coating agent, which prevents the surfaces of the building from being neutralized and reinforces the printing material, to the corresponding position after the printing material is sprayed. Thus, the printing apparatus 1 may be applied for carrying out the printing on the inner and outer surfaces of the building and applying the coating agent.

The printing material sprayed form the spray means 2 may be made of a printing material that is applied to the piezo method so that the printing material is sprayed in a piezo method by applying electrical vibration and a physical pressure to water-soluble metallic salts stain in a direction of the floor or surface to allow the metallic salt stain to be permeated into the surface of the floor of the building. The print text refers to pictures, texts, graphics, 3D graphics, gradient printing, and the like.

Also, the spray means 2 may be made of a printing material that is applied to the UV curing method so that a UV curable material is applied to the inner surface and the surface of the building to be constructed and is cured through ultraviolet rays (UV) to adhere and thereby to form a print text. It is preferable that the spray means 2 is applied according to user's selection.

Printing ink used in the piezo method according to the user's selection or printing ink made of the UV curable material may be contained in the spray means 2, and the spray means 2 may differently operate according to kinds of printing ink contained in the spray means 2. For this, a separate switch (not shown) that is capable of selecting the piezo method or the UV curing method may be provided in a body 3, or an operation mode may be selected through an input of a keypad means 8.

The above-described printing apparatus 1 according to this embodiment includes the body 3 to which the spray means 2 is fixed so that a nozzle hole through which the printing material is sprayed is disposed to face the floor so as to spray the printing material in the direction of the floor.

The body 3 may have a plate shape, i.e., a frame shape in which the spray means 2 is disposed therein or on a surface thereof.

Also, the printing apparatus 1 according to this embodiment includes a moving means 4 that is disposed on both ends of the body 3 to receive power and thereby to move the body 3 in front/rear and left/right directions.

Thus, the body 3 may travel to a desired position and direction and at a desired speed on an object to be printed (hereinafter, referred to as a printing object). As a result, the printing material may be sprayed onto the surface of the printing object through the nozzle hole while the body 3 travels.

It is preferable that the moving means 4 includes a caterpillar belt that receives the power controlled at the outside to allow the body 3 to travel to the desired position and in the desired direction. Also, it is preferable that the moving means 4 has a slip prevention structure that is capable of smoothly traveling without being slipped on the surface of the printing object.

Preferably, the slip prevention structure may be provided as a roller fixed to the body so as to rotate at an angle of 360 degrees, but is not limited thereto.

Also, the printing apparatus 1 according to this embodiment includes a photographing means 5 that is disposed on the body 3 to photograph the surface of the printing object while the body 3 travels and thereby to datafy the surface state of the printing object.

Thus, the photographing means 5 may photograph the surface of the printing object while the body 3 travels on the printing object to datafy and also perform the printing while confirming the printed state of the printing object.

Furthermore, the printing may be smoothly performed while adequately corresponding to and avoiding an obstacle disposed on the printing object on the basis of the state of the photographed printing object.

In the photographing means 5, it is most preferable that a photographing part for photographing the printing object is disposed on the bottom surface of the body 3 and provided as a movie camera to photograph the surface state of the printing object, thereby obtaining data in real-time.

The printing apparatus 1 according to this embodiment includes a distance measuring means 6 provided on the body 3 to measure a spaced distance between the surface of the printing object and the body 3 while the body 3 travels, thereby datafying the distance.

As a result, in case in which a distance between the nozzle hole of the spray means 2 and the printing object is datafied, and then the printing is performed, when the spray means 2 and the coating agent application means 14 are manipulated to spray the printing material and the coating agent, useful conditions may be obtained.

Thus, the printing material may be effectively sprayed onto the printing object to improve printing quality and also more effectively apply the coating agent.

In addition, the printing apparatus 1 according to this embodiment includes a control means that calculates the surface state of the printing object that is datafied through the photographing means 5 and the distance measuring means 6 and controls the moving means 4, the spray means 2, and the coating agent application means 14 according to the inputted data so that the printing material and the coating agent are sprayed onto the printing object on the basis of the set data.

Thus, the user may recognize the surface state of the printing object, which is datafied through the photographing means 5 and the distance measuring means 6, through the control means to control the moving unit 4, the spray means 2, and the coating agent application means 14, thereby automatically spraying the printing material onto the surface of the printing object so that the printing is performed, and also, thereby applying the coating agent so that the printing is performed in real-time. That is, required amounts of ink and coating agent to be sprayed may be measured and controlled by using a distance measuring function of the distance measuring means 6.

Preferably, the body 3 may include a display means 7 for forming an image of the data calculated by the control means so that the user visually recognizes the data through his/her naked eyes and a keypad means 8 that is manipulated to input the printing conditions into the control means.

That is, the user may input the printing conditions through the keypad means 8 while visually recognizing the printing conditions through the display means 7 or manipulate the keypad means 8 while visually recognize the state of the progress of the printing through his/her naked eyes. Also, an operation mode of the piezo method or the UV curing method may be selected through the keypad means 8.

Furthermore, it is preferable that the control means is capable of inputting the data and manipulating the data input by manipulating a remote controller (not shown), but is not limited thereto.

In this way, the worker may directly control the remote controller at the work site while manipulating the remote controller to perform the printing work.

Also, in the printing apparatus 1 according to this embodiment, it is preferable that the body 3 includes a USD reader 9 for inputting the data into the control means from the outside to perform the work by inputting the necessary data from the outside, and also, the body 3 includes a battery 10 for applying power to the photographing means 5, the distance measuring means 6, the spray means 7, and the coating agent application means 14.

Although the power is directly supplied to the control means in a wired manner, it is preferable to supply the power while charging the battery 10.

In case in which the printing material sprayed from the spray means 2 is made of a printing material to be applied to the UV curing method, the body 3 includes a curing means 11 that emits light through the battery or a power source applied from the outside to allow the printing material sprayed onto the printing object through the spray means 2 to be VU-cured. When the UV curing method is selected through the switch (not shown) or the keypad 8, the curing means 11 may operate while the body 3 travels to UV-cure the printing material printed on the surface of the printing object. It is preferable that an LED lamp is used as the curing means 11.

When the printing material sprayed from the spray means 2 is a printing material used in the piezo method, and the piezo method is selected through the switch (not shown) or the keypad 8, the curing means 11 does not operate. That is, the curing means 11 is controlled so as to not operate.

The coating agent application means 14 for spraying the coating agent, which prevents the concrete from being neutralized and reinforce the surface of the building, onto the surface of the building in the state in which the print text is formed may be mounted on a rear end of the body 3 or the curing means 11.

Referring to FIG. 2, the coating agent application means 14 is mounted on the rear end of the body 3. Referring to FIG. 3, the coating agent application means 14 is mounted on the curing means 11.

The printing ink is sprayed from the spray means 2 in the UV curing method, and the curing means 11 operates to UV-cure the printing material printed on the surface of the printing object. Then, the coating agent application means 14 mounted on the rear end of the body 3 or the curing means 11 sprays the coating agent. That is, since the coating agent application means 14 sprays the coating agent to the UV-cured position, the forming of the print text by using the UV curable material, the curing through the ultraviolet rays (UV), and the coating of the coating agent may be performed at once.

In case of the piezo method, the spray means 2 sprays the printing ink in the piezo method, and the coating agent application means 14 mounted on the rear end of the body 3 or the curing means 11 sprays the coating agent. That is, since the coating agent application means 14 sprays the coating agent to the position at which the printing ink is sprayed in the piezo method, the forming of the print text in the piezo method and the coating of the coating agent may be performed at once.

In case in which the coating agent application means 14 is mounted on the rear end of the body 3, it is preferable to fix and install the coating agent application means 14 through a connection frame 12. In case in which the coating agent application means 14 is mounted on the curing means 11, it is preferable to fix and install the coating agent application means 14 to a rear portion of the curing means 11 through a fixing frame 13.

In case of the above-described installation, when viewed from one side of the printing apparatus 1, the spray means 2, the curing means 11, and the coating agent application means 14 may be sequentially disposed, and thus, the spraying of the printing ink in the piezo method or the UV curing method while the printing apparatus 1 travels, the curing through the ultraviolet rays (UV), and the spraying of the coating agent may be sequentially performed.

As a result, in case in which the printing apparatus 1 according to the present invention is used, a printing step of forming the print text and a coating agent applying step of preventing the surface of the building from being neutralized and reinforcing the surface of the building may be performed at once while the body 3 travels.

Hereinafter, an operation and effect of the apparatus for carrying out the printing on the inner and outer surfaces of the building according to this embodiment will be described.

When the surface of the building is printed by using the printing apparatus 1 according to this embodiment, the printing apparatus 1 according to this embodiment is disposed first on the printing object, and then, the work data is inputted through the keypad means 8 to perform the work, or the worker may adjust the work one by one by using the remote controller to perform the work.

As described above, since the control means is controlled through the set data or the remote controller to drive the moving means 4, when the body 3 travels on the printing object to perform the printing operation, data with respect to the surface state and the distance of the printing object is obtained through the photographing means 5 and the distance measuring means 6, and the surface state and the distance are calculated by the control means on the basis of the obtained data to display the surface state and the distance in various forms through the display means so that the worker recognizes the surface state and the distance.

Here, the state of the printing object may be outputted on the display means 7 as an image, and particularly, displayed as a 3D image.

As described above, after the state of the printing object is secured as the data, when the worker inputs a desired printing pattern into the control means, the control means controls and drives the moving means 4, the spray means 2, and the coating agent application means 14 to spray the printing material while traveling on the printing object and spray the coating agent so that the coating agent is applied to the printed position.

As described above, in case in which the printing material is made of a printing material applied to the UV curing method, the printing material is printed while curing the printing material sprayed onto the printing object through the curing means 11 for the UV curing.

As described above, the printing apparatus 1 according to this embodiment may automatically print texts and designs according to the inputted data while traveling on the surface of the building built with the concrete structure to reduce the construction time and improve the printing effect of the building.

Also, since the coating agent may be applied after the printing, the printing and the coating may be performed at once.

First Embodiment

FIG. 1 is a view illustrating a method for carrying out printing on inner and outer surfaces of a building according to an embodiment of the present invention. The method for carrying out the printing on the inner and outer surfaces of the building according to this embodiment is performed to print a print text on the inner and outer surfaces of the building and adequately applied to the construction of the print text on the inner and outer surfaces of the building that is mainly made of concrete, but is not limited thereto.

In the construction method according to this embodiment, the UV curable material is applied to the inner surface and the surface of the building to be constructed and then is cured through the ultraviolet rays (UV) to adhere, thereby forming the print text. The print text refers to pictures, texts, graphics, 3D graphics, gradient printing, and the like. That is, the print text is printed on the inner and outer surface of the building in the UV curing printing method. Here, the UV curable material for forming the print text adheres to the surfaces and is printed to be integrated with the surface.

Thus, since the worker constructs the text in a mechanical configuration without manually constructing the text like the existing painting construction method, various types of print texts may be formed, and the print text may be detailed and clear to more secure the recognition of the text.

Thus, since the various and detailed print texts are expressed, an identifier may clearly recognize information, and the printing effect may be improved.

Hereinafter, the method for carrying out the printing on the inner and outer surfaces of the building according to this embodiment will be described in more detail.

First, the method for carrying out the printing according to this embodiment includes a pre-processing step of removing foreign matters from the inner and outer surfaces of the building to be constructed by using a pre-processing device (S110).

That is, it is preferable to remove laitance on the surfaces of the building through the pre-processing step. Also, it is preferable to perform a separate grinding process for flattening the floor.

For this, the pre-processing step further includes a grinding process of grinding the inner and outer surfaces of the building to be constructed by using a grinder (S120). The floor flattening operation (removal of a release agent in the concrete, compound, residue, tire marks, and other contaminants) is carried out through the grinding process to ensure flatness and washing.

Also, after the grinding process, it is preferable to remove roughness of the surface of the building through a polishing process for performing polishing by using a diamond pad and remove pores from the surface (S130).

As described above, the construction method according to this embodiment includes a printing step of curing ink through the ultraviolet rays (UV) by using the curing means 1 of the printing apparatus 1 to adhere, thereby forming a print text after the ink made of the UV curable material is applied on the surface of the building, which is cleaned through the pre-processing step, by using the spray means 2 (S140).

That is, the print text is printed to be integrated with the surface of the building in the UV curing printing method. In the printing step, a desired amount of printing ink to be sprayed is measured by using the distance measuring function of the printing apparatus 1, and then, the print text is formed by using the amount of printing ink, thereby realizing accurate printing.

Also, the construction method according to this embodiment further include a coating step of applying and drying the coating agent by using the coating agent application means 14 of the printing apparatus 1 to prevent the surface from being neutralized and reinforce the surface in the state in which the print text is formed on the surface through the printing step (S150). In the coating step, a desired amount of coating agent to be sprayed is measured by using the distance measuring function of the printing apparatus 1, and then, the coating agent is applied by using the amount of printing ink, thereby realizing accurate coating.

It is preferable that the coating agent applied to the coating step is made of a concrete floor reinforcing agent that is made of a mixture of lime, clay, a mineral, aluminum, silicate, and a polymer to cause calcification reaction between the pores of the concrete, thereby stabilizing and reinforcing the structure of the concrete. That is, the coating agent, the surface of the building, and the UV curable material may be integrated and reinforced in the state in which the UV curable material adheres to the surface by the coating agent to prevent the print text from being separated from the surface, thereby improving stability.

It is preferable that the coating agent is cured and dried for 2 hours to 24 hours.

Also, when the coating of the coating agent on the surface of the building is completed through the coating step, a glossing step (S160) of polishing the surface of the building by using a diamond resin pad is performed. Then, a surface protection agent coating step in which a water repellent agent, a sealer, or a wax is applied to the surface of the building that is polished through the glossing step to buff the surface by using a buffing pad and thereby to perform water repellent on the surface is preferably further performed (S170).

That is, the surface of the building may be polished and smoothly glossed by using the coating agent, and also, durability of the surface may increase through the water repellency, and contaminants on the surface may be easily removed.

Second Embodiment

FIG. 2 is a view illustrating a method for carrying out printing on a building and concrete floors and walls according to another embodiment of the present invention. The method for carrying out the printing on the inner and outer surfaces of the building according to this embodiment is adequately applied to the construction of a print text on the building and the concrete floors and wall, but is not limited thereto. The print text refers to pictures, texts, graphics, 3D graphics, gradient printing, and the like.

In the method for carrying out the printing according to this embodiment, the printing is performed in a piezo method in which water-soluble metallic salt stain is sprayed by applying a pressure to the building and the concrete floors and walls in a direction of the building and the concrete floors and walls so that the metallic salt stain is permeated into the building and the concrete floors and walls to form the print text.

That is, since the water-soluble metallic salts are printed on the building and the concrete floors and walls in the piezo method, the water-soluble metallic salts may be permeated into the floors and thus are printed to be integrated with the building and the concrete floors and walls.

Thus, as the conventional printing method, the ink on the building and the concrete floors and walls does not protrude and thus is not easily damaged. As a result, the print text may be united with the concrete and thus semi-permanently stably maintained.

Furthermore, since the various and detailed print texts are formed, an identifier may clearly recognize information, and the printing effect may be improved.

It is preferable that the metallic salt stain has acidity of PH 0.1 to PH 6.0 and has a particle size of 10 nm to 500 nm in a water-soluble state.

The metallic salt stain is well dispersed in a solvent such as pure water, ethyl alcohol, acetone, etc., in a water-soluble metallic salt state corresponding to alkaline earth metals (metal elements), transition elements (metals), and metal elements after the transition. Also, since the metallic salt stain does not cause chemical and physical reaction with the solvent and also does not cause chemical reaction with binder materials such as silicon, acrylic, and vinyl based on its application characteristics, the metallic salt stain may be stable.

Hereinafter, the method for carrying out the printing on the building and the concrete floors and walls according to this embodiment will be described in more detail.

First, the method for carrying out the printing according to this embodiment includes a pre-processing step of removing foreign matters from the concrete surfaces constituting the concrete floors and walls by using a pre-processing device (S210).

That is, it is preferable to remove surface laitance on the building and the concrete floors and walls through the pre-processing step. Also, it is preferable to perform a separate grinding process for flattening the floor.

For this, the pre-processing step further includes a grinding process of grinding the surfaces of the building and the concrete floors and walls by using a grinder (S220). The surface flattening operation (removal of a release agent in the concrete, compound, residue, tire marks, and other contaminants) is carried out the grinding process to ensure flatness and wash the surface.

Also, after the grinding process, it is preferable to remove roughness of the surfaces of the building and the concrete floors and walls through a polishing process for performing polishing by using a diamond pad and remove pores from the surface (S230).

The method for carrying out the printing according to this embodiment includes a spray step of spraying the water-soluble metallic salt stain to the building and the concrete floors and walls, which are cleaned through the pre-processing step, by using the spray means 2 of the printing apparatus 1 in the piezo method by applying electrical vibration and a physical pressure in a direction of the surface to allow the metallic salt stain to be permeated into the surfaces of the building and the concrete floors and walls and thereby to form a print text (S240).

In the spray step, a desired amount of necessary printing ink to be sprayed is measured by using a distance measuring function of the printing apparatus 1, and then, the print text is formed by using the amount of printing ink, thereby realizing accurate printing.

Thus, as described above, the water-soluble metallic salt is permeated into the building and the concrete floors and walls and thus printed to be integrated with the building and the concrete floors and walls.

Also, the method for carrying out the printing according to this embodiment further include a coating step of applying and drying a coating agent by using a coating agent application means 14 of the printing apparatus 1 to prevent the surfaces of the building and the concrete floors and walls from being neutralized and reinforce the surfaces in the state in which the print text is formed on the surfaces of the building and the concrete floors and wells through the spray step (S250).

In the coating step, a desired amount of coating agent to be sprayed is measured by using the distance measuring function of the printing apparatus 1, and then, the coating agent is applied by using the amount of printing ink, thereby realizing accurate coating.

It is preferable that the coating agent applied to the coating step is made of a concrete floor reinforcing agent that is made of a mixture of lime, clay, a mineral, aluminum, silicate, and a polymer to cause calcification reaction between the pores of the concrete, thereby stabilizing and reinforcing the structure of the concrete.

That is, in the state in which the metallic salt stain is permeated into the building and the concrete floors and walls, the coating agent, and the concrete surface, and the metallic salt stain may be integrated to be reinforced to prevent the metallic salt stain from being separated from the building and all the concrete floors and walls by the coating agent, thereby improving stability.

It is preferable that the coating agent is cured and dried for 2 hours to 24 hours.

Also, when the coating of the coating agent on the surfaces of the building and the concrete floors and walls is completed through the coating step, a glossing step (S260)

of polishing the surfaces of the building and the concrete floors and walls by using a diamond resin pad is performed. Then, a surface protection agent coating step in which a water repellent agent is applied to the surfaces of the building and the concrete floors and walls that are polished through the glossing step to buff the surfaces by using a buffing pad and thereby to perform water repellent on the surfaces of the building and the concrete floors and walls is preferably further performed (S270).

That is, in the state in which the surface of the metallic salt stain and the floors and walls are integrally coated with the coating agent, the surfaces of the floors and walls may be polished and smoothly glossed, and also, durability of the surface may increase through the water repellency, and contaminants on the surface may be easily removed.

In the method for carrying out the printing on the inner and outer surfaces of the building according to the present invention, the print text may be stably formed on the building and all the concrete floors and walls in the indoor and outdoor spaces of the building, and also, since the print text is permeated into the building and the all the concrete floors and walls so as to be formed, the print text may be clear and particularly be stable because the print text is not damaged even when a long time passes.

Also, when the 3D printing is performed on the surfaces of the building in the UV curing method or the piezo method according to this embodiment, stereoscopic feeling as if the real thing is realized may be provided.

Also, the process for each step may create various construction processes according to the user's selection. That is, construction processes which do not include the step of grinding the floors and walls or the step of polishing the floors and walls or do not include the step of applying and buffing the floors and walls by using the sealer, the water repellent agent, and the wax to protect the surfaces may be created.

That is, the user may select and apply the process according to the conditions of the floors and walls.

While the present invention has been described with reference to the exemplary embodiments, it is to be understood that the invention is not limited to the disclosed exemplary embodiments, but various modifications may be made without departing from the spirit of the invention. Thus, the embodiment of the present invention is to be considered illustrative, and not restrictive, and the technical spirit of the present invention is not limited to the foregoing embodiment. Therefore, the scope of the invention is defined not by the detailed description of the invention but by the appended claims, and all differences within the scope will be construed as being included in the present invention.

The invention claimed is:

1. A method for carrying out printing on inner and outer surfaces of a building, which performs printing of a print text on the inner and outer surfaces of the building by using a printing apparatus in which printing ink used for a piezo method or printing ink made of a UV curable material is contained in a spray means according to user's selection, the piezo method or a UV curing method is selected according to a type of the printing ink contained in the spray means, and the spray means, a curing means, and a coating agent application means are sequentially disposed to sequentially perform spraying of the printing ink in the piezo method or the UV curing method, curing of the printing ink, and spraying of a coating agent while the apparatus travels, the method comprising:

a pre-processing step of removing foreign matters from the inner and outer surfaces of the building;

a printing step of applying ink made of the UV curable material onto the inner and outer surfaces of the building, which is cleaned through the pre-processing step, by using the spray means of the printing apparatus and curing the applied ink through ultraviolet rays (UV) by using the curing means of the printing apparatus to adhere, thereby forming the print text;

a coating step of applying the coating agent by using the coating agent application means to prevent the surfaces of the building from being neutralized and reinforce the surfaces in a state in which the print text is formed on the surfaces of the building through the printing step;

a glossing step of polishing the inner and outer surfaces by using a diamond resin pad when the coating of the surfaces by using the coating agent is completed through the coating step; and a surface protection agent coating step of applying a water repellent agent onto the surfaces of the building, which are polished through the glossing step, to buff the surfaces by using a buffing pad, thereby performing water repellent on the surfaces of the building, wherein the printing apparatus operates to select the piezo method or the UV curing method through an input of a separate switch or keypad means to operate, and the coating agent application means is mounted on a rear end of a body or the curing means to spray the coating agent to a UV-cured position, in the printing step and the coating step, a desired amount of the printing ink and an amount of the coating agent to be applied are measured by using a distance measuring function of the printing apparatus to form the print text by using the measured amounts, and the body has a plate shape and is provided with the spray means therein or on a surface thereof, and a moving means receiving power to move the body in front/rear and left/right sides is disposed on each of both ends of the body.

2. The method of claim 1, wherein the pre-processing step further comprises a grinding process of grinding the surfaces of the building by using a grinder to flatten the surfaces.

3. The method of claim 2, wherein the pre-processing step further comprises a polishing process of polishing the surfaces by using a diamond pad after the grinding process.

4. The method of claim 1, wherein the moving means comprises a caterpillar belt that allows the body to travel to a desired position and in a desired direction and has a slip prevention structure that is capable of smoothly traveling without being slipped on a surface of an object to be printed.

5. The method of claim 1, wherein a photographing means that is disposed on the body to photograph a surface of an object to be printed while the body travels and thereby to datafy a surface state of the object to be printed; and a distance measuring means disposed on the body to measure a spaced distance between the object to be printed and the body while the body travels and thereby to datafy the measured distance are provided.

6. The method of claim 5, wherein a control means that calculates the surface state of the object to be printed, which is datafied through the photographing means and the distance measuring means and controls the moving means, the spray means, and the coating agent application means according to inputted data so that a printing material and the coating agent are sprayed onto the surface of the object to be printed on a basis of set data is provided.

7. The method of claim 6, wherein the body comprises:

a display means for forming an image of the data calculated by the control means so that a user visually recognizes the data through his/her naked eyes; and a keypad means for allowing the user to input printing conditions into the control means.

8. A method for carrying out printing on inner and outer surfaces of a building, which performs printing of a print text on the inner and outer surfaces of the building by using a printing apparatus in which printing ink used for a piezo method or printing ink made of a UV curable material is contained in a spray means according to user's selection, the piezo method or a UV curing method is selected according to a type of the printing ink contained in the spray means, and the spray means, a curing means, and a coating agent application means are sequentially disposed to sequentially perform spraying of the printing ink in the piezo method or the UV curing method, curing of the printing ink, and spraying of a coating agent while the apparatus travels, the method comprising:

a pre-processing step of removing foreign matters from a surface of concrete constituting the surfaces of the building;

a spray step of spraying a water-soluble metallic salt stain to the inner and outer surfaces of the building, which are cleaned through the pre-processing step, by using the spray means of the printing apparatus in the piezo method by applying electrical vibration and a physical pressure in a direction of the surface to allow the metallic salt stain to be permeated into the surfaces of the building and thereby to form the print text;

a coating step of applying and drying the coating agent by using the coating agent application means of the printing apparatus to prevent the surfaces of the building from being neutralized and reinforce the surfaces in a state in which the print text is formed on the surfaces of the building through the spray step;

a glossing step of polishing the surfaces by using a diamond resin pad when the coating on the surfaces by using the coating agent is completed through the coating step; and a surface protection agent coating step of applying a water repellent agent onto the surfaces, which are polished through the glossing step, to buff the surfaces by using a buffing pad, thereby performing water repellent on the surfaces of the building, wherein the printing apparatus operates select the piezo method or the UV curing method through an input of a separate switch or keypad means to operate, and the coating agent application means is mounted on a rear end of a body or the curing means to spray the coating agent to a position at which the printing ink is sprayed in the piezo method, in the printing step and the coating step, a desired amount of the printing ink and an amount of the coating agent to be applied are measured by using a distance measuring function of the printing apparatus to form the print text by using the measured amounts, and the body has a plate shape and is provided with the spray means therein or on a surface thereof, and a moving means receiving power to move the body in front/rear and left/right sides is disposed on each of both ends of the body.

9. The method of claim 8, wherein the metallic salt stain has acidity ranging from PH 0.1 to PH 0.6.

10. The method of claim 8, wherein the metallic salt stain has a particle size of 10 nm to 500 nm in a water-soluble state.

11. The method of claim 8, wherein the pre-processing step further comprises a grinding process of grinding the surfaces of the building by using a grinder to flatten the surfaces.

12. The method of claim 11, wherein the pre-processing step further comprises a polishing process of polishing the surfaces by using a diamond pad after the grinding process.

13. The method of claim 8, wherein the moving means comprises a caterpillar belt that allows the body to travel to a desired position and in a desired direction and has a slip prevention structure that is capable of smoothly traveling without being slipped on a surface of an object to be printed.

14. The method of claim 8, wherein a photographing means that is disposed on the body to photograph a surface of an object to be printed while the body travels and thereby to datafy a surface state of the object to be printed; and a distance measuring means disposed on the body to measure a spaced distance between the object to be printed and the body while the body travels and thereby to datafy the measured distance are provided.

15. The method of claim 14, wherein a control means that calculates the surface state of the object to be printed, which is datafied through the photographing means and the distance measuring means and controls the moving means, the spray means, and the coating agent application means according to the inputted data so that a printing material and the coating agent are sprayed onto the surface of the object to be printed on a basis of set data is provided.

16. The method of claim 15, wherein the body comprises:

a display means for forming an image of the data calculated by the control means so that a user visually recognizes the data through his/her naked eyes; and a keypad means for allowing the user to input printing conditions into the control means.

* * * * *